US007828418B2

(12) United States Patent
Iwata

(10) Patent No.: US 7,828,418 B2
(45) **Date of Patent: *Nov. 9, 2010**

(54) METHOD FOR FORMING MARK AND LIQUID EJECTION APPARATUS

(75) Inventor: Yuji Iwata, Suwa (JP)

(73) Assignee: Seiko Epson Corporation (JP)

( * ) Notice: Subject to any disclaimer, the term of this patent is extended or adjusted under 35 U.S.C. 154(b) by 1049 days.

This patent is subject to a terminal disclaimer.

(21) Appl. No.: 11/591,412

(22) Filed: Oct. 26, 2006

(65) Prior Publication Data

US 2007/0117038 A1 May 24, 2007

(30) Foreign Application Priority Data

Oct. 28, 2005 (JP) ..... 2005-315137
Oct. 10, 2006 (JP) ..... 2006-276855

(51) Int. Cl.
*B41J 29/38* (2006.01)
*B41J 25/308* (2006.01)
*B41J 2/015* (2006.01)
*B41J 2/01* (2006.01)

(52) U.S. Cl. ..... 347/51; 347/6; 347/8; 347/20; 347/102

(58) Field of Classification Search ..... 347/8, 347/102

See application file for complete search history.

(56) References Cited

U.S. PATENT DOCUMENTS

| | | | | |
|---|---|---|---|---|
| 7,059,705 | B2 | 6/2006 | Iwata | |
| 7,156,515 | B2 | 1/2007 | Iwata | |
| 2006/0023046 | A1* | 2/2006 | Miura et al. | 347/102 |
| 2007/0097198 | A1* | 5/2007 | Iwata | 347/102 |

FOREIGN PATENT DOCUMENTS

| | | |
|---|---|---|
| JP | 11-077340 | 3/1999 |
| JP | 2003-127537 | 5/2003 |
| KR | 2004-0041016 | 5/2004 |
| KR | 2004-0065151 | 7/2004 |

* cited by examiner

*Primary Examiner*—Matthew Luu
*Assistant Examiner*—Kendrick X Liu
(74) *Attorney, Agent, or Firm*—Harness, Dickey & Pierce, P.L.C.

(57) ABSTRACT

A method for forming a mark includes ejecting a droplet of a liquid containing a mark forming material onto a surface of an object; radiating a laser beam from a radiation port to a predetermined radiation target position; moving at least one of the object and the radiation port relative to the other in such a manner that the laser beam radiated from the radiation port is radiated onto the droplet on the surface, wherein the droplet forms a mark on the surface by being irradiated with the laser beam; and pivoting the radiation port about the radiation target position as a pivot axis so as to set a radiation angle of the laser beam.

2 Claims, 7 Drawing Sheets

METHOD FOR FORMING MARK AND LIQUID EJECTION APPARATUS

BACKGROUND

The entire disclosure of Japanese Patent Application No. 2005-315137, filed on Oct., 28, 2005, and Japanese Patent Application No. 2006-276855, filed on Oct., 10, 2006, is expressly incorporated by reference herein.

1. Technical Field

The present invention relates to a method for forming a mark and a liquid ejection apparatus.

2. Related Art

Normally, an electro-optic apparatus such as a liquid crystal display or an electroluminescence display includes a substrate that displays an image. The substrate has an identification code (for example, a two-dimensional code) including product information regarding the name of the manufacturer and the product number, for purposes of quality control and production control. The identification code includes a plurality of dots formed by, for example, colored thin films or recesses. The dots are arranged in a predetermined pattern so that the identification code can be identified in accordance with the arrangement pattern of the dots.

As a method for forming an identification code, JP-A-11-77340 discloses a laser sputtering method and JP-A-2003-127537 discloses a waterjet method. In the laser sputtering method, a code pattern is formed through sputtering by radiating a laser beam onto a metal foil. In the waterjet method, dots are marked on a substrate by ejecting water containing abrasive onto the substrate.

However, in the laser sputtering method, the interval between the metal foil and the substrate must be adjusted to several micrometers to several tens of micrometers in order to form each dot in a desired size. The substrate and the metal foil thus must have extremely flat surfaces and adjustment of the interval between the substrate and the metal foil must be carried out with accuracy on the order of micrometers. This limits application of the method to a restricted range of substrates, and the use of the method is limited. In the waterjet method, the substrate may be contaminated by water, dust, and the abrasive that are splashed when the identification code is formed.

In order to solve these problems, an inkjet method has been focused on as an alternative method for forming an identification code. In the inkjet method, dots are provided on a substrate by ejecting droplets of liquid containing metal particles from nozzles of an ejection head onto the substrate. The droplets are then dried to provide the dots. The method thus can be applied to a relatively wide range of substrate materials. Further, the method prevents contamination of the substrate caused by formation of the identification code.

In most of cases where the inkjet method is employed, the composition (for example, the metal particles or dispersion medium) of the liquid to be ejected or the size of a droplet must be changed in correspondence with the type of the dots or the surface condition of the substrate. Therefore, if drying of the droplets can be carried out in correspondence with the composition of the liquid and the size of the droplet in the drying process, formation of a pattern by the dots obtained from the droplets is facilitated. Further, the inkjet method becomes applicable to a wider range of use.

As one such droplet drying method, for example, a laser beam with an alterable radiation angle may be radiated onto a zone on the substrate corresponding to each of the droplets, thus irradiating the droplet with the laser beam. This instantly solidifies the target droplet. The optical cross section and the energy density of the laser beam are thus changed in correspondence with the type of the liquid forming the droplets and the size of each droplet.

Specifically, if the radiation angle of the laser beam radiated onto each droplet is altered, that is, if the position of a laser head that radiates the laser beam is changed, the radiating position of the laser beam changes correspondingly. Therefore, the radiating position of the laser beam must be corrected in correspondence with changes to the liquid forming the droplets or the size of each droplet. This consumes time and may lower productivity for forming code patterns.

SUMMARY OF THE INVENTION

Accordingly, it is an objective of the present invention to provide a method for forming a mark and a liquid ejection apparatus capable of changing the radiation angle of a laser beam radiated onto a droplet of liquid while maintaining accuracy of the position of radiation of the laser beam.

According to one aspect of the invention, a method for forming a mark includes ejecting a droplet of a liquid containing a mark forming material onto a surface of an object; radiating a laser beam from a radiation port to a predetermined radiation target position; moving at least one of the object and the radiation port relative to the other in such a manner that the laser beam radiated from the radiation port is radiated onto the droplet on the surface, wherein the droplet forms a mark on the surface by being irradiated with the laser beam; and pivoting the radiation port about the radiation target position as a pivot axis so as to set a radiation angle of the laser beam.

According to another aspect of the invention, a method for forming a mark includes ejecting a droplet of a liquid containing a mark forming material onto a surface of an object; radiating a laser beam from a radiation port and guiding the laser beam to a predetermined radiation target position, wherein the guiding of the laser beam to the radiation target position includes: radiating the laser beam from the radiation port onto a first reflective surface parallel with the surface; reflecting the laser beam that has been received by the first reflective surface from the first reflective surface onto a second reflective surface opposed to the surface; and reflecting the laser beam that has been received by the second reflective surface from the second reflective surface onto the radiation target position; moving at least one of the object and the radiation port relative to the other in such a manner that the laser beam radiated from the radiation port is radiated onto the droplet on the surface, wherein the droplet forms a mark on the surface by being irradiated with the laser beam; and pivoting the radiation port about a point on a normal line of the surface including the radiation target position as a pivot axis so as to set a radiation angle of the laser beam with respect to the first reflective surface, wherein, if the number of times of reflections of the laser beam by the first reflective surface is represented by n, the distance between the first reflective surface and the second reflective surface is represented by Hr, and the distance between the radiation target position and the pivot axis is represented by Hpc, the pivot axis is set in such a manner as to satisfy the following equation: $Hpc=n\times2\times Hr$.

According to yet another aspect of the invention, a liquid ejection apparatus includes a liquid ejection head, a laser radiation device, and a relative movement device. The liquid ejection head ejects a droplet of a liquid containing a mark forming material onto a surface of a target. The laser radiation device includes a radiation port. The laser radiation device radiates a laser beam from the radiation port onto a predetermined radiation target position. The laser radiation device includes a pivot mechanism. The pivot mechanism pivots the radiation port about the radiation target position as a pivot axis so as to set a radiation angle of the laser beam. The relative movement device moves at least one of the object and the radiation port in such a manner that the laser beam radiated from the radiation port is radiated onto the droplet on the surface.

According to still another aspect of the invention, a liquid ejection apparatus includes a liquid ejection head, a laser radiation device having a first reflector, a second reflector, and a pivot mechanism, and a relative movement device. The liquid ejection head ejects a droplet of a liquid containing a mark forming material onto a surface of a target. The laser radiation device has a radiation port. The laser radiation device radiates a laser beam from the radiation port and guides the laser beam to a predetermined radiation target position. The first reflector has a first reflective surface parallel with the surface. The first reflective surface receives the laser beam from the radiation port and reflects the laser beam onto the liquid ejection head. The second reflector has a second reflective surface opposed to the surface. The second reflective surface receives the laser beam from the first reflective surface and reflects the laser beam onto the radiation target position. The pivot mechanism pivots the radiation port about a point on a normal line of the surface including the radiation target position as a pivot axis so as to set a radiation angle of the laser beam with respect to the first reflective surface. If the number of times of reflections of the laser beam by the first reflective surface is represented by n, the distance between the first reflective surface and the second reflective surface is represented by Hr, and the distance between the radiation target position and the pivot axis is represented by Hpc, the pivot axis is set in such a manner as to satisfy the following equation: $Hpc=n\times2\times Hr$. The relative movement device moves at least one of the object and the radiation port relative to the other in such a manner that the laser beam radiated from the radiation port is radiated onto the droplet on the surface.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 to 6. First, a liquid crystal display 1 having an identification code formed by a method for forming a mark according to the present invention will be explained.

Figure 1:
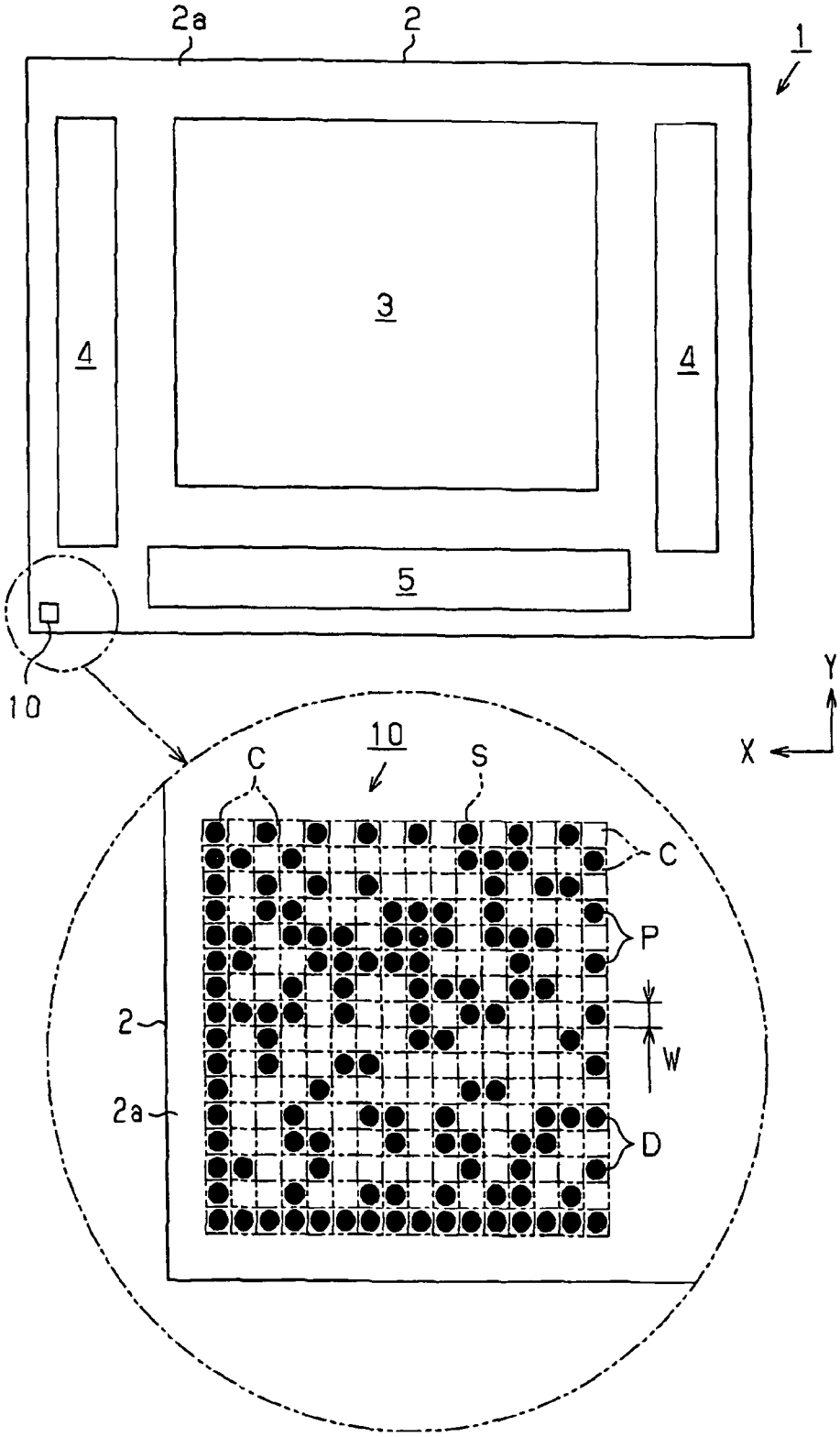
FIG. 1 is a plan view showing a liquid crystal display.

As shown in FIG. 1, a display portion 3 is formed on one of the surfaces of a substrate 2 of the liquid crystal display 1, or on a surface 2*a*. The substrate 2 is an object onto which droplets of liquid are ejected. The display portion 3 has a rectangular shape. Liquid crystal molecules are sealed in a substantial central portion of the display portion 3. The surface 2*a* receives droplets of liquid that have been ejected. A scanning line driver circuit 4 and a data line driver circuit 5 are formed outside the display portion 3. The liquid crystal display 1 controls orientation of the liquid crystal molecules in the display portion 3 in correspondence with scanning signals generated by the scanning line driver circuit 4 and data signals generated by the data line driver circuit 5. The liquid crystal display 1 modulates area light emitted by a lighting device (not shown) in accordance with an orientation state of the liquid crystal molecules, thus displaying a desired image in an area of the display portion 3.

Referring to FIG. 1, a code formation area S (indicated in the circle formed by the double-dotted chain line), a square each side of which is approximately 1 mm long, is defined in the lower left corner of the surface 2*a*. The code formation area S is virtually divided into data cells C of 16 rows by 16 lines. A dot D (or a mark) is formed in each of some selected data cells C. The dots D are arranged in accordance with a prescribed pattern, forming an identification code 10 of the liquid crystal display 1.

In the first embodiment, an ejection target position P corresponds to the center of each of the data cells D in which the dots D are provided. The cell width W is the length of each side of the data cell D.

Each dot D has a semispherical shape with an outer diameter coinciding with the length of each side of the data cell C, or the cell width W. To form the dots D, droplets Fb of liquid F (see FIG. 4) prepared by dispersing metal particles (for example, nickel or manganese particles), or dot forming material, in dispersion medium are ejected onto the selected data cells C. The droplets Fb are then dried and baked in the corresponding data cells C. Such drying and baking of the droplets Fb is performed through radiation of laser beams B (see FIG. 5). In the first embodiment, the dots D are formed by drying and baking the droplets Fb. However, formation of the dots D may be carried out in any other suitable manner. For example, the droplets Fb may be provided simply by drying the laser beams B.

The identification code 10 may reproduce product information of the liquid crystal display 1 including the product number or the lot number in accordance with the pattern formed by the dots D in the data cells C.

In FIGS. 1 to 5, direction X corresponds to a longitudinal direction of the substrate 2. Direction Y corresponds to a lateral direction of the substrate 2, or a direction perpendicular to direction X. Direction Z is a direction vertical to directions X and Y. Specifically, the directions indicated by the arrows of the drawings will be referred to as defined as direction +X, direction +Y, and direction +Z. The directions opposite to these directions will be referred to as direction −X, direction −Y, and direction −Z.

Figure 2:
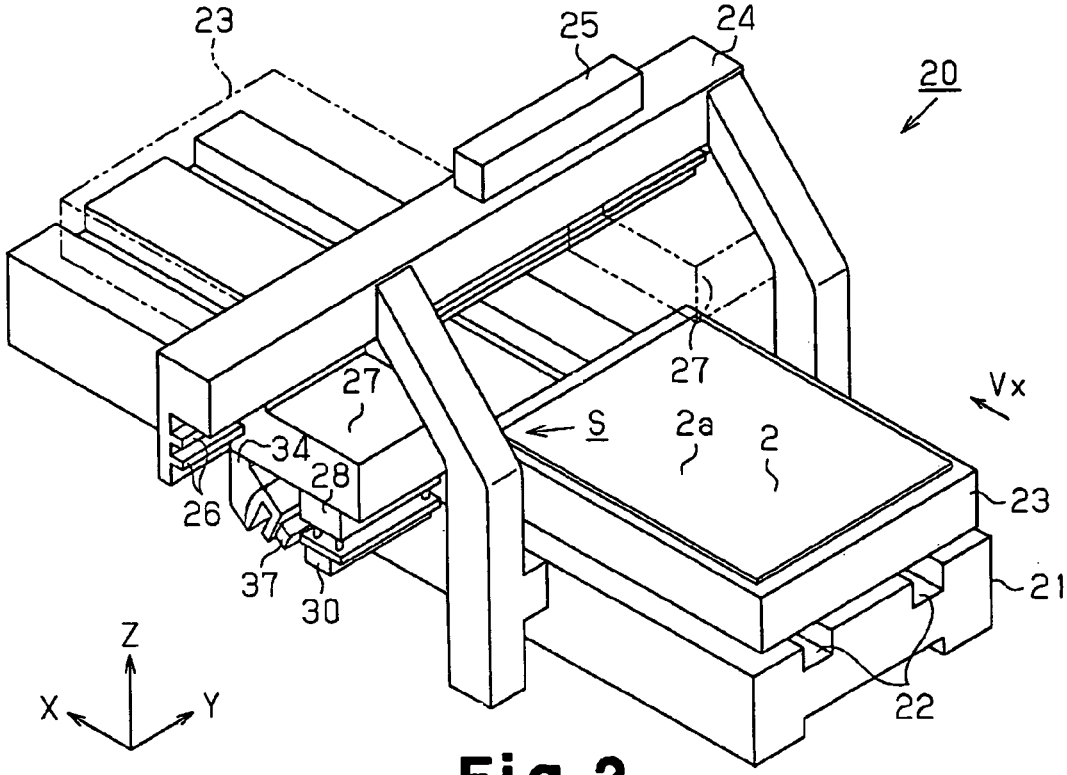
FIG. 2 is a perspective view schematically showing a liquid ejection apparatus.

Next, a liquid ejection apparatus 20 by which the identification code 10 is formed will be explained. As shown in FIG. 2, the liquid ejection apparatus 20 has a base 21. The base 21 is formed in a parallelepiped shape and the longitudinal direction of the base 21 corresponds to direction X. A pair of guide grooves 22, which extend in direction X, are defined in an upper surface of the base 21. A substrate stage 23, which serves as a relative movement device, is provided on the base 21. The substrate stage 23 is operably connected to an X-axis motor MX (see FIG. 6) that is provided on the base 21 and translated and slides along the guide grooves 22 in direction X at a predetermined speed (transport speed Vx). A suction type chuck mechanism (not shown) is arranged on the substrate stage 23. The substrate 2 is positioned and fixed to an upper surface of the substrate stage 23 with the surface 2*a* (the code formation area S) facing upward.

A guide member 24 extends in direction Y of the base 21. As viewed in direction X, the guide member 24 is shaped like a gate. A reservoir tank 25 is provided on the guide member 24. The reservoir tank 25 retains the liquid F and supplies the liquid F to an ejection head 30. A pair of guide rails 26 are formed below the guide member 24, extending along the entire width of the guide member 24 in direction Y. A carriage 27 is attached to the guide rails 26. The carriage 27 is operably connected to a Y-axis motor MY (see FIG. 6) that is provided on the guide member 24 and linearly moves on the guide rails 26.

A support member 28 is provided below the carriage 27. The support member 28 has a parallelepiped shape, and extends in direction Y. The liquid ejection head 30 (hereinafter, referred to simply as the ejection head 30) is secured to a lower surface of the support member 28.

Figure 3:
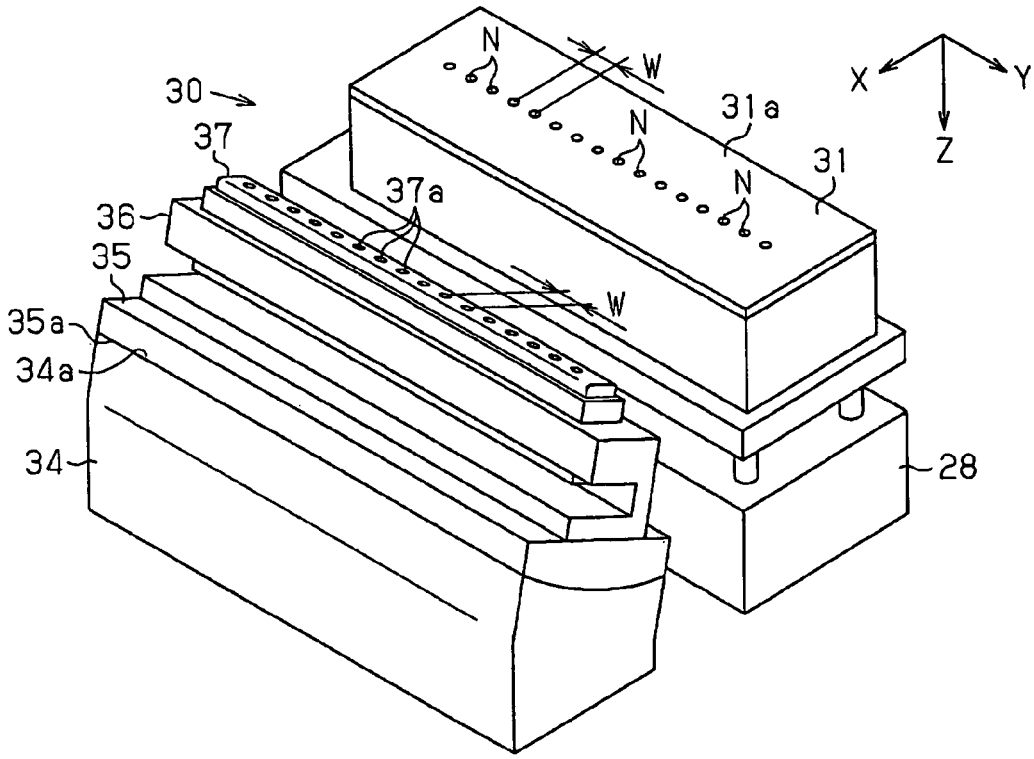
FIG. 3 is a perspective view schematically showing an ejection head according to a first embodiment of the present invention.

A nozzle plate 31 is formed on an upper surface of the nozzle head 30 as viewed in FIG. 3. The nozzle plate 31 has a nozzle forming surface 31*a* extending parallel with the surface 2*a* of the substrate 2. Sixteen nozzles N extend through the nozzle forming surface 31*a* in a normal direction of the substrate 2 (direction Z) and are spaced at equal intervals (the pitch width corresponding to the cell width W) in direction Y.

Figure 4:
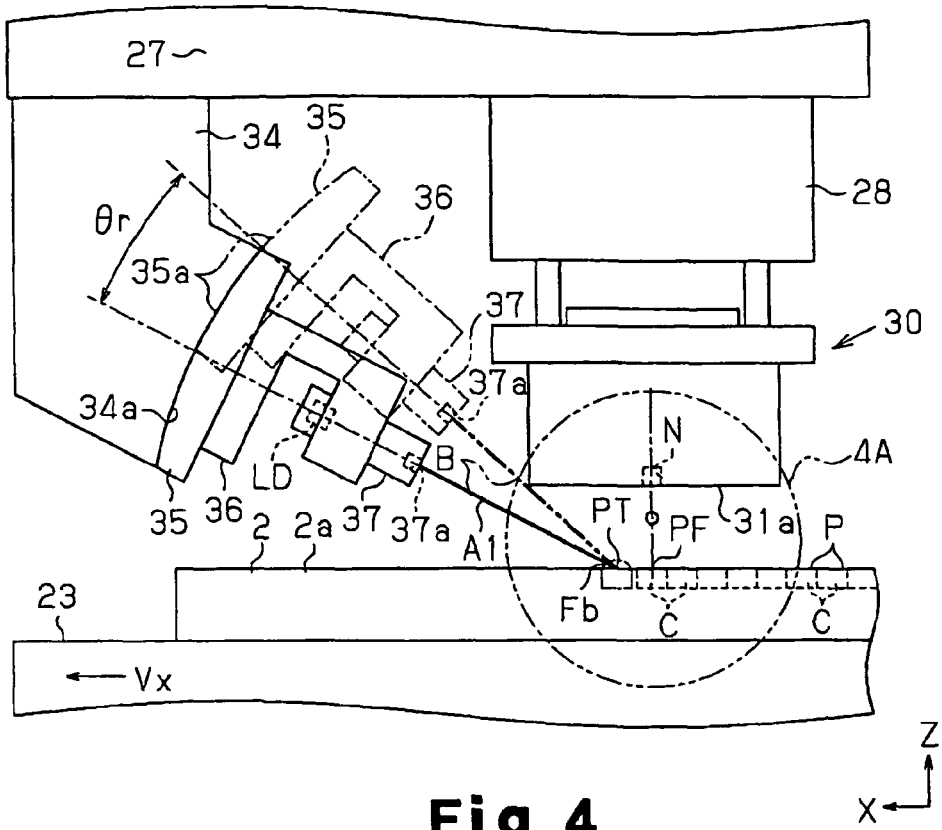
FIG. 4 is a view showing the ejection head of FIG. 3.
Figure 4A:
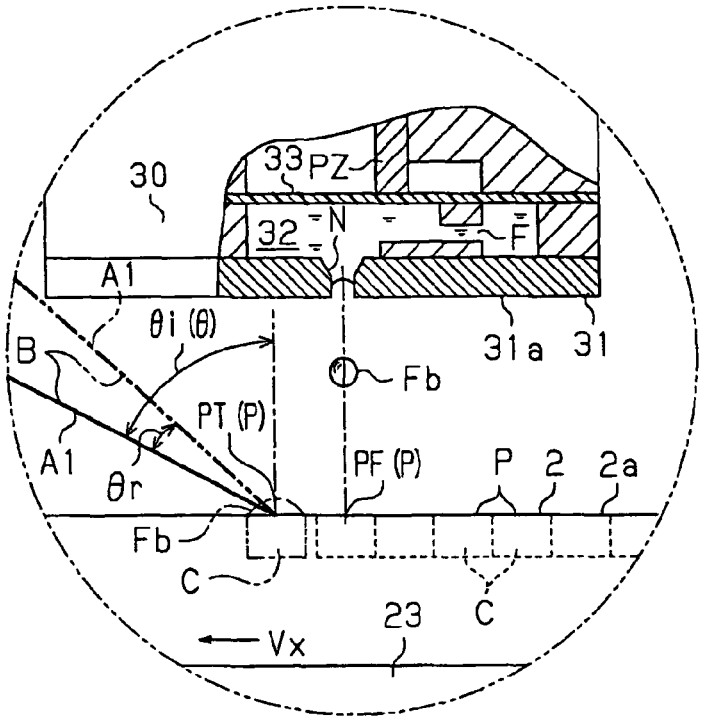
FIG. 4A is an enlarged partial view of a part of FIG. 4 indicated by a circle 4A.

In the first embodiment, with reference to FIG. 4, a droplet receiving position PF corresponds to a position opposed to the corresponding one of the nozzles N on the surface 2*a* at which a droplet Fb is received by the substrate 2.

As illustrated in FIG. 4, a cavity 32 is defined above each of the nozzles N and communicates with the reservoir tank 25. Each of the cavities 32 supplies the liquid F from the reservoir tank 25 to the corresponding one of the nozzles N. An oscillation plate 33 is bonded with the upper surfaces of the walls defining each of the cavities 32. Each of the oscillation plates 33 oscillates in an upward-downward direction and increases or reduces the volume of the corresponding one of the cavities 32. Sixteen piezoelectric elements PZ are arranged on the oscillation plates 33 in correspondence with the nozzles N. Upon receiving a signal for controlling actuation of the piezoelectric element PZ (piezoelectric element drive voltage COM1: see FIG. 6), each of the piezoelectric elements PZ causes oscillation of the corresponding one of the oscillation plates 33 in the upward-downward direction.

When the ejection target position P of each data cell C coincides with the corresponding droplet receiving position PF in transportation of the substrate stage 23 in direction +X at the transport speed Vx, the corresponding piezoelectric element PZ receives the drive voltage COM1. Each of the piezoelectric element PZ then increases and decreases the volume of the associated cavity 32, oscillating the surface of the liquid F in the corresponding nozzle N. This causes ejection of a predetermined amount of the liquid F as a droplet Fb from the nozzle N. The droplet Fb then travels downward, or in direction −Z, and is received by the substrate 2 at the droplet receiving position PF (the ejection target position P).

As the substrate stage 23 is continuously transported, the droplet Fb that has reached the ejection target position P proceeds in direction X. As time elapses in such transportation, the droplet Fb spread wet in the corresponding data cell C and reaches a size at which the droplet Fb should be dried (in the first embodiment, drying of the droplet Fb is performed when the outer diameter of the droplet Fb coincides with the cell width W).

In the first embodiment, a radiation target position PT corresponds to the center (the ejection target position P) of the droplet Fb, which is transported. When the droplet Fb is located at the radiation target position PT, the outer diameter of the droplet Fb coincides with the cell width W (as viewed in the circles formed by the double-dotted chain lines of FIG. 4). The radiation standby time corresponds to the time from when ejection of a droplet Fb starts to when the ejected droplet Fb reaches the radiation target position PT.

With reference to FIG. 4, a guide member 34 is located below the carriage 27. The guide member 34 is arranged forward from the support member 28 (the ejection head 30) in the proceeding direction of the substrate 2, or in direction +X. The guide member 34 forms a pivot mechanism. The guide member 34 extends along a substantially entire width of the carriage 27 in direction Y and has an L-shaped cross section. The guide member 34 has a guide surface 34*a*. As viewed in direction Y, the guide surface 34*a* is a concave surface formed in an arcuate shape with the radiation target position PT as the center of radius. The guide surface 34*a* is formed along the entire width of the guide member 34 in direction Y.

A pivot stage 35, which extends in direction Y, is arranged on the guide surface 34*a* of the guide member 34. The pivot stage 35 forms the pivot mechanism. The pivot stage 35 extends in direction Y and has a sliding surface 35*a*, or a convex surface shaped in a matching manner with the guide surface 34*a*. The pivot stage 35 is operably connected to a pivot motor MR (see FIG. 6) through a worm gear or the like (not shown) installed in the guide member 34. The pivot stage 35 operates in such a manner that the sliding surface 35*a* slides or pivots on the guide surface 34*a*.

Specifically, upon receiving a signal for pivoting the pivot stage 35 (a pivot motor drive signal SMR: see FIG. 6) by the pivot motor MR, the pivot motor MR is driven to rotate in a forward direction or a reverse direction. The pivot stage 35 is then operated to pivot clockwise or counterclockwise as viewed in FIG. 4 about the radiation target positions PT, in such a manner that the sliding surface 35*a* and the guide surface 34*a* become flush.

In the first embodiment, as indicated by the corresponding solid lines of FIG. 4, a reference position of the pivot stage 35 corresponds to the position of the pivot stage 35 at which the sliding surface 35*a* contacts the guide surface 34*a*. Further, as indicated by the corresponding broken lines of the drawing, a radiating position of the pivot stage 35 corresponds to the position of the pivot stage 35 pivoted from the reference position in a clockwise direction at a predetermined angle (pivot angle θr).

Referring to FIG. 3, the pivot stage 35 has a positioning member 36 extending in direction Y, which has a yoke-shaped cross-sectional shape. A laser head 37, which serves as a laser-irradiating device, is secured to the positioning member 36. The laser head 37 extends in direction Y and has a parallelepiped shape. The positioning member 36 positions the laser head 37. Sixteen radiation ports 37*a* are formed in a surface of the laser head 37 corresponding to the substrate 2. The radiation ports 37*a* are aligned in direction Y and spaced at equal intervals (the pitch corresponding to the cell width W). Each of the radiation ports 37*a* corresponds to one of the nozzles N.

With reference to FIG. 4, sixteen semiconductor lasers LD are provided in the laser head 37 at positions corresponding to the nozzles N and the radiation ports 37*a*. Each of the semiconductor lasers LD radiates a laser beam B with a wavelength range corresponding to the absorption wavelength of the liquid F. The laser head 37, which is positioned by the positioning member 36, radiates the laser beam B from the respective semiconductor lasers LD from the radiation ports 37*a* toward the guide surface 34*a* or the sliding surface in the inwardly radial direction.

In the first embodiment, the radiation angle θ corresponds to the angle between the optical axis A1 of the laser beam B from each radiation port 37*a* and a normal direction of the substrate 2 (direction Z). The reference radiation angle θi corresponds to the radiation angle θ at which the pivot stage 35 is located at the reference position.

As the pivot motor MR rotates in the forward direction, the pivot stage 35 moves from the reference position to the radiating position. Then pivots each of the radiation ports 37*a* clockwise about the pivot axis PT. In this situation, the radiation angle θ of the laser beam B is reduced from the reference radiation angle θi by an amount corresponding to the pivot angle θr while the position onto which the laser beam B is radiated is maintained at the radiation target position PT.

In this manner, the liquid ejection apparatus 20 may vary the radiation angle θ of the laser beam B while maintaining accuracy of the radiating position of the laser beam B from each radiation port 37*a*.

Figure 5:
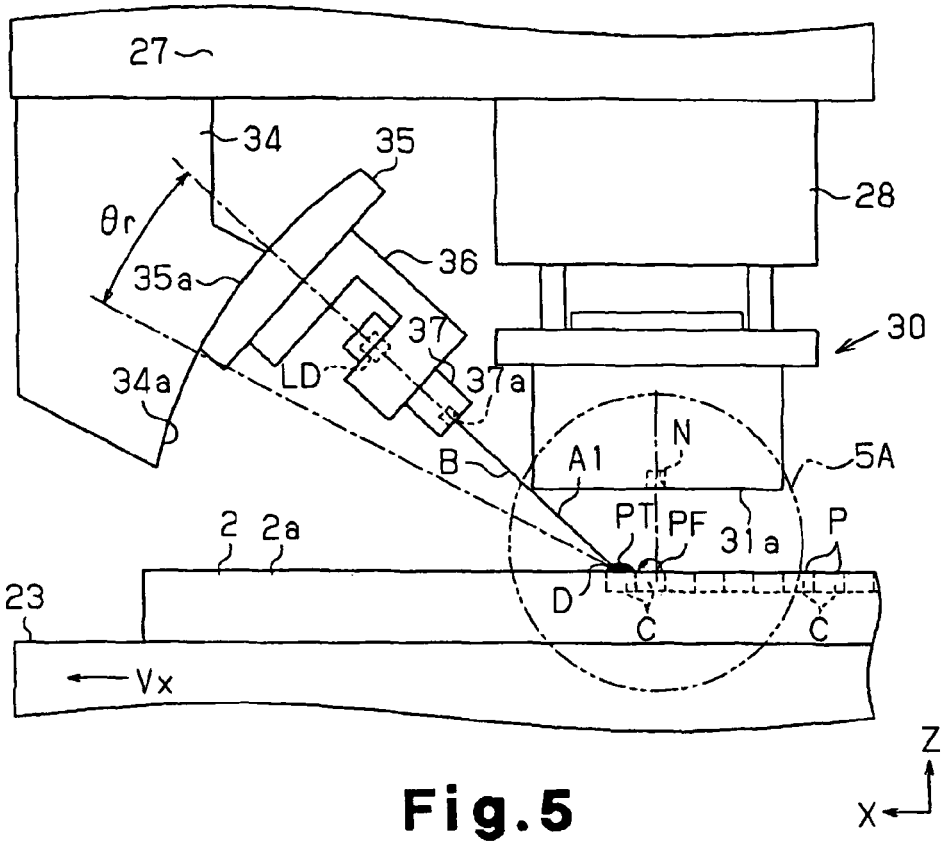
FIG. 5 is a view showing the ejection head of FIG. 3.
Figure 5A:
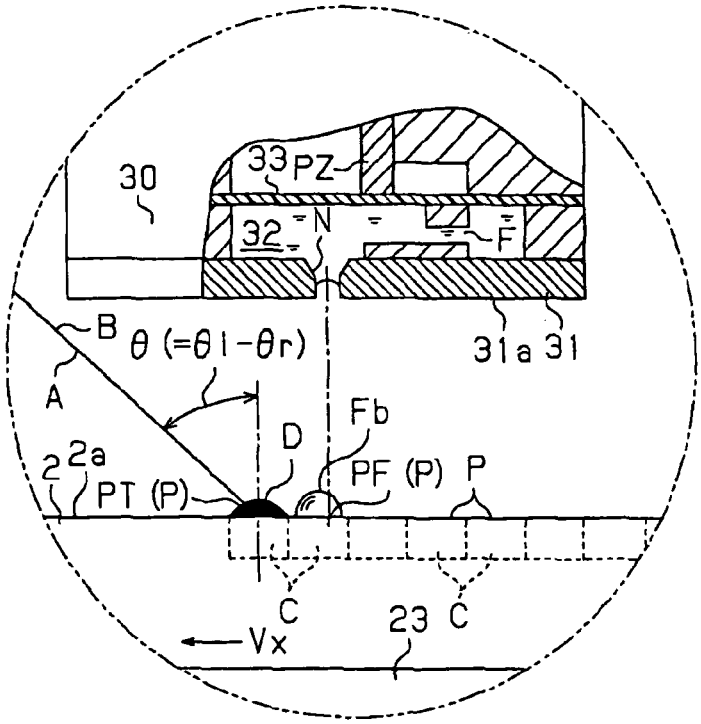
FIG. 5A is an enlarged partial view of a part of FIG. 4 indicated by a circle 5A.
Figure 6:
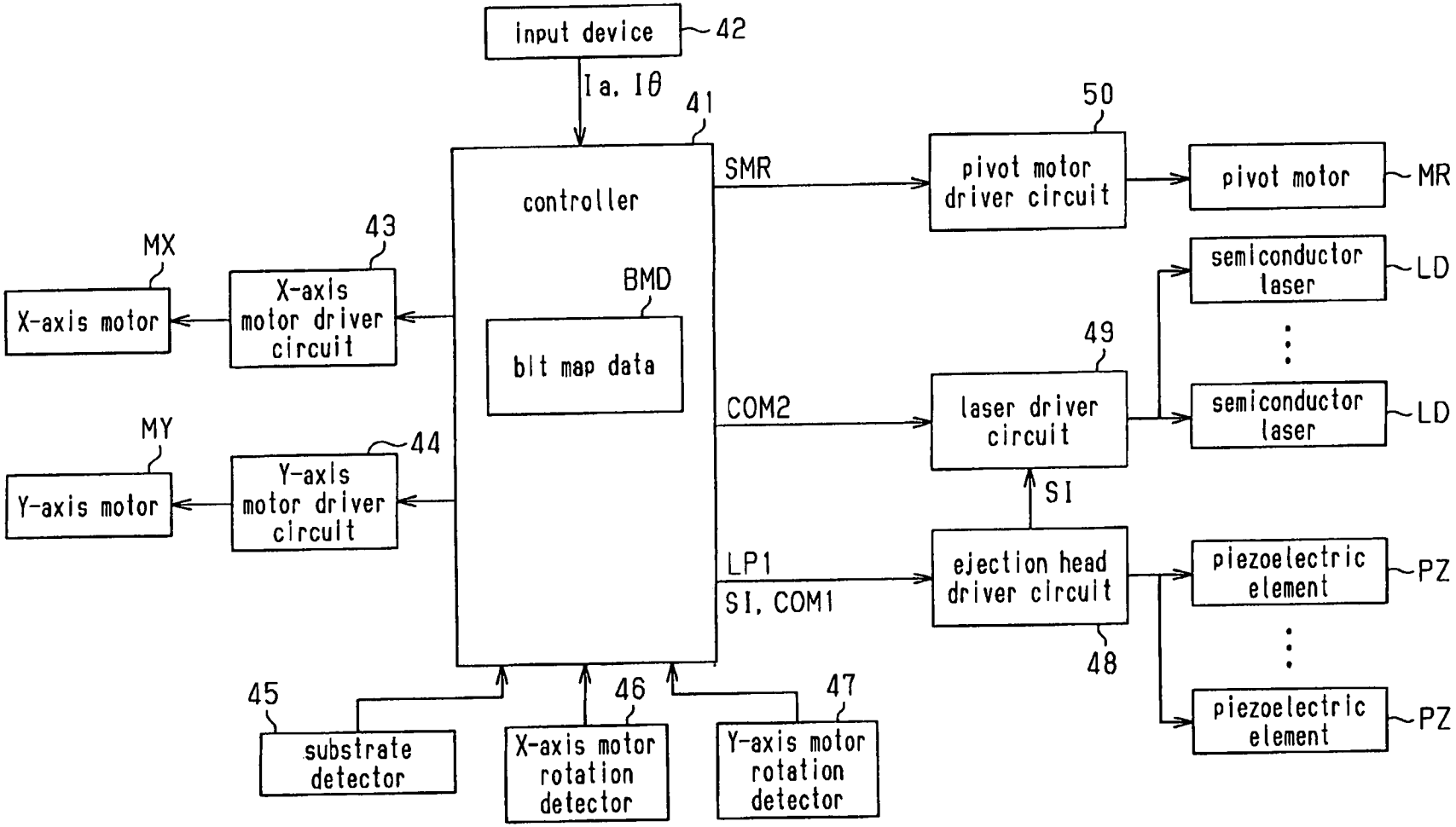
FIG. 6 is a block diagram representing the electric configuration of the liquid ejection apparatus.

When the data cells C (the droplets Fb) enter the zones corresponding to the radiation target positions PT in transportation of the substrate stage 23 in direction +X at the transport speed Vx, with the radiation ports 37*a* maintained as pointed at the corresponding radiating positions, each of the semiconductor lasers LD receives a drive signal for radiating a laser beam B (laser drive voltage COM2: see FIG. 6). The laser beams B are thus radiated from the associated radiation ports 37*a* toward the corresponding radiation target positions PT as illustrated in FIG. 5. This instantly dries and solidifies the droplets Fb passing the radiation target positions PT. After having been solidified, the droplets Fb are continuously irradiated with the laser beams B and the metal particles of the droplets Fb are baked. This provides the dots D fixed to the surface 2*a* of the substrate 2.

By this time, the radiation angle θ of each laser beam B radiated onto the corresponding droplet Fb has been decreased by the pivoting amount of the pivot stage 35, or the amount corresponding to the pivot angle θr. The energy density of the laser beam B radiated onto the droplet Fb has been correspondingly increased. The radiating positions of the laser beams B are maintained at the radiation target positions PT through pivoting of the pivot stage 35.

Therefore, the liquid ejection apparatus 20, through pivoting of the pivot stage 35, can eliminate insufficient energy produced by the laser beams B, or insufficient drying of the droplets Fb, and thus can maintain the accuracy of the radiating positions of the laser beams B.

The electric configuration of the liquid ejection apparatus 20 will hereafter be described with reference to FIG. 6.

Referring to FIG. 6, a controller 41 has a CPU, a RAM, and a ROM. The ROM stores various data and various control programs. The controller 41 transports the substrate stage 23 and operates the ejection head 30, the laser head 37, and the pivot stage 35 in correspondence with the data and in accordance with the control programs.

An input device 42 including manipulation switches such as a start switch or a stop switch is connected to the controller 41. An image of the identification code 10 is input from the input device 42 to the controller 41 as a prescribed form of imaging data Ia. The pivot angle θr of the pivot stage 35 is also input from the input device 42 to the controller 41 as a prescribed form of pivot angle data Iθ. In correspondence with the imaging data Ia input from the input device 42, the controller 41 generates bit map data BMD, the piezoelectric element drive voltage COM1, and the laser drive voltage COM2. Further, the input device 42 generates a pivot motor drive signal SMR in correspondence with the pivot angle data Iθ input from the input device 42.

The bit map data BMD indicates whether to excite the piezoelectric elements PZ in correspondence with the corresponding bit values (0 or 1). That is, the bit map data BMD indicates whether to eject the droplets Fb onto the data cells C defined in a two-dimensional imaging surface (the code formation area S).

The controller 41 is connected to an X-axis motor driver circuit 43 and outputs a corresponding control signal to the X-axis motor driver circuit 43. In correspondence with the control signal of the controller 41, the X-axis motor driver circuit 43 operates to rotate the X-axis motor MX in a forward direction or a reverse direction. The controller 41 is connected to a Y-axis motor driver circuit 44 and outputs a corresponding control signal to the Y-axis motor driver circuit 44. In correspondence with the control signal of the controller 41, the Y-axis motor driver circuit 44 operates to rotate the Y-axis motor MY in a forward direction or a reverse direction. The controller 41 is connected to a substrate detector 45 capable of detecting an end of the substrate 2. The controller 41 calculates the position of the substrate 2 that is passing the droplet receiving position PF, based on a detection signal generated by the substrate detector 45.

An X-axis motor rotation detector 46 is connected to the controller 41 and sends a detection signal to the controller 41. In correspondence with the detection signal of the X-axis motor rotation detector 46, the controller 41 calculates the movement direction and the movement amount (the current position) of the substrate stage 23 (the substrate 2). The controller 41 sends an ejection timing signal LP1 to an ejection head driver circuit 48 when the center of each data cell C coincides with the corresponding droplet receiving position PF.

A Y-axis motor rotation detector 47 is connected to the controller 41 and outputs a detection signal to the controller 41. In correspondence with the detection signal of the Y-axis motor rotation detector 47, the controller 41 calculates the movement direction and the movement amount (the current position) of the ejection head 30 (the laser head 37) in direction Y. The controller 41 then operates in such a manner that the droplet receiving positions PF corresponding to the nozzles N are located on the movement paths of the corresponding ejection target positions P.

The controller 41 is connected to an ejection head driver circuit 48 and provides an ejection timing signal LP1 to the ejection head driver circuit 48. The controller 41 synchronizes the piezoelectric element drive voltage COM1 with a prescribed clock signal and supplies the piezoelectric element drive voltage COM1 to the ejection head driver circuit 48. Further, the controller 41 generates ejection control signals SI synchronized with a prescribed reference clock signal based on the bit map data BMD and serially transfers the ejection control signals SI to the ejection head driver circuit 48. The ejection head driver circuit 48 converts the serial ejection control signals SI from the controller 41 to the parallel signals corresponding to the piezoelectric elements PZ.

Upon receiving the ejection timing signal LP1 from the controller 41, the ejection head driver circuit 48 supplies the piezoelectric element drive voltage COM1 to the piezoelectric elements PZ that are selected based on the ejection control signals SI. Further, the ejection head driver circuit 48 outputs the parallel ejection control signals SI, which have been converted from the serial signals, to a laser driver circuit 49.

The controller 41 is connected to the laser driver circuit 49 and outputs the laser drive voltage COM2 to the laser driver circuit 49 synchronously with a prescribed clock signal.

Upon receiving the ejection control signals SI from the ejection head driver circuit 48, the laser driver circuit 49 waits a predetermined time (radiation standby time) and then supplies the laser drive voltage COM2 to the semiconductor lasers LD that selected based on the ejection control signals SI. In other words, every time the droplets Fb on the substrate 2 reach the radiation target positions PT, the controller 41 operates the laser driver circuit 49 to radiate the laser beams B onto the zones where the droplets Fb are disposed.

The controller 41 is connected to a pivot motor driver circuit 50 and sends a pivot motor drive signal SMR to the pivot motor driver circuit 50. In response to the pivot motor drive signal SMR from the controller 41, the pivot motor driver circuit 50 operates to rotate the pivot motor MR, which drives the pivot stage 35 to pivot, in a forward or reverse direction. In this manner, the pivot stage 35 is (the radiation ports 37*a* are) pivoted at the pivot angle θr.

A method for forming the identification code 10 using the liquid ejection apparatus 20 will hereafter be described.

First, as illustrated in FIG. 2, the substrate 2 is fixed to the substrate stage 23 with the surface 2*a* facing upward. At this stage, the substrate 2 is located in direction −X from the guide member 24 (the carriage 27). The pivot stage 35 is arranged at the reference position.

The input device 42 is then manipulated to input the imaging data Ia and the pivot angle data Iθ to the controller 41. The controller 41 then generates and stores the bit map data BMD in correspondence with the imaging data Ia and produces the piezoelectric element drive voltage COM1 and the laser drive voltage COM2. Subsequently, the controller 41 starts operating the Y-axis motor MY. The carriage 27 is (the nozzles N are) thus set at a position (positions) in direction Y in such a manner that, when the substrate 2 is transported in direction +X, the ejection target positions P pass the corresponding droplet receiving positions PF.

Further, the controller 41 generates the pivot motor drive signal SMR based on the pivot angle data Iθ and outputs the pivot motor drive signal SMR to the pivot motor driver circuit 50. The controller 41 then operates the pivot motor driver circuit 50 to rotate the pivot motor MR in the forward direction, thus pivoting the pivot stage 35 from the reference position to the radiating position. In this manner, the radiation angle θ of each laser beam B is adjusted while maintaining accuracy of the radiating positions of the laser beams B from the radiation ports 37*a*.

After having pivoted the pivot stage 35 to the radiating position, the controller 41 operates the X-axis motor MX to start transportation of the substrate 2 in direction +X. The controller 41 determines whether the ejection target positions P of the foremost ones of the data cells C in direction X have reached the positions immediately below the nozzles N, in correspondence with the detection signals of the substrate detector 45 and the X-axis motor rotation detector 46.

Meanwhile, the controller 41 outputs the ejection control signals SI to the ejection head driver circuit 48 and supplies the piezoelectric drive voltage COM1 and the laser drive voltage COM2 to the ejection head driver circuit 48 and the laser driver circuit 49, respectively.

When the ejection target positions P of the foremost ones of the data cells C in direction +X reach the corresponding droplet receiving positions PF, the controller 41 outputs the ejection timing signal LP1 to the ejection head driver circuit 48.

After having sent the ejection timing signal LP1 to the ejection head driver circuit 48, the controller 41 operates the ejection head driver circuit 48 to supply the piezoelectric element drive voltage COM1 to the piezoelectric elements PZ selected based on the ejection control signals SI. In this manner, the corresponding nozzles N are caused to simultaneously eject the droplets Fb. The droplets Fb are then received by the substrate 2 at the corresponding ejection target positions P. As the substrate stage 23 is transported, the droplets Fb on the substrate 2 proceed in direction +X. The droplets Fb then spread wet in the corresponding data cells C as time elapses. By the time the radiation standby time elapses since starting of ejection, the controller 41 has operated to transport the droplets Fb from the ejection target positions P to the radiation target positions PT where the outer diameter of each droplet Fb coincides with the cell width W.

Further, after having output the ejection timing signal LP1 to the ejection head driver circuit 48, the controller 41 operates the laser driver circuit 49 in such a manner that the semiconductor lasers LD stand by for the radiation standby time. The controller 41 then supplies the laser drive voltage COM2 to the semiconductor lasers LD selected in correspondence with the ejection control signals SI from the ejection head driver circuit 48. The controller 41 thus operates to simultaneously radiate the laser beams B from the selected semiconductor lasers LD.

Through pivoting of the pivot stage 35, the radiation angle θ of the laser beams B is decreased by the amount corresponding to the pivot angle θr, which increases the energy density of the laser beams B with respect to the corresponding droplets Fb. In addition, the radiating positions of the laser beams B from the semiconductor lasers LD are maintained at the corresponding radiation target positions PT. In this manner, while insufficienct radiation energy of the laser beams B with respect to the droplets Fb or insufficient drying of the droplets Fb are eliminated, the dots D with the outer diameter coinciding with the cell width W are formed on the surface 2*a* of the substrate 2. Thus, the liquid ejection apparatus 20 makes it possible to form the dots D sized in correspondence with the cell width W in the first data cells C in direction +X.

Thereafter, the controller 41 operates to continuously transport the substrate 2 in direction +X. Each time the ejection target positions P reach the corresponding droplet receiving positions PF, the controller 41 causes simultaneous ejection of the droplets Fb from the selected nozzles N. Then, when each droplet Fb reaches the size corresponding to the cell width W, the laser beams B are radiated onto the zones corresponding to the droplets Fb. In this manner, all of the necessary dots D are provided in the code formation area S.

The first embodiment, which is configured as above-described, has the following advantages.

The pivot stage 35 is provided in the carriage 27 and pivots about the pivot axis coinciding with the radiation target positions PT. The pivot stage 35 includes the laser head 37. As the pivot stage 35 is pivoted from the reference position to the radiating position, the radiation ports 37*a* of the laser head 37 pivot about the corresponding radiation target positions PT. This decreases the radiation angle θ of each laser beam B by the amount corresponding to the pivot angle θr of the pivot stage 35.

Therefore, while changing the radiation angle θ of the laser beams B, the radiating positions of the laser beams B are maintained at the corresponding radiation target positions PT. As a result, while maintaining accuracy of the radiating positions of the laser beams B, the radiation angle θ of the laser beams B with respect to the droplets Fb can be changed independently.

Further, regardless of changing of the radiation angle θ, the distance (the optical path length) between each radiation port 37*a* and the corresponding radiation target position PT is maintained. The size and shape of the optical cross section formed on the surface 2*a* may be defined by the radiation angle θ only. Therefore, desired optical cross section or energy density of the laser beam B may be more reliably provided to the zones corresponding to the droplets Fb.

As a result, while maintaining the position and its position accuracy of the laser beams B, the conditions for radiating the laser beams B are changed in correspondence with the composition and the size of each droplet Fb and the condition of the surface 2*a*. This enlarges the applicable range of the inkjet method for forming patterns.

A second embodiment of the present invention will now be described with reference to FIGS. 7 and 8. In the second embodiment, a reflective mirror M, or a first reflector, is provided in the vicinity of the ejection head 30 of the first embodiment. The center of radius of the guide surface 34*a* is different from that of the second embodiment. The following description thus focuses on the differences between the first embodiment and the second embodiment regarding the reflective mirror M and the guide surface 34*a*. In the second embodiment, directions X, Y, and Z are defined in the same manner as those of the first embodiment.

Figure 7:
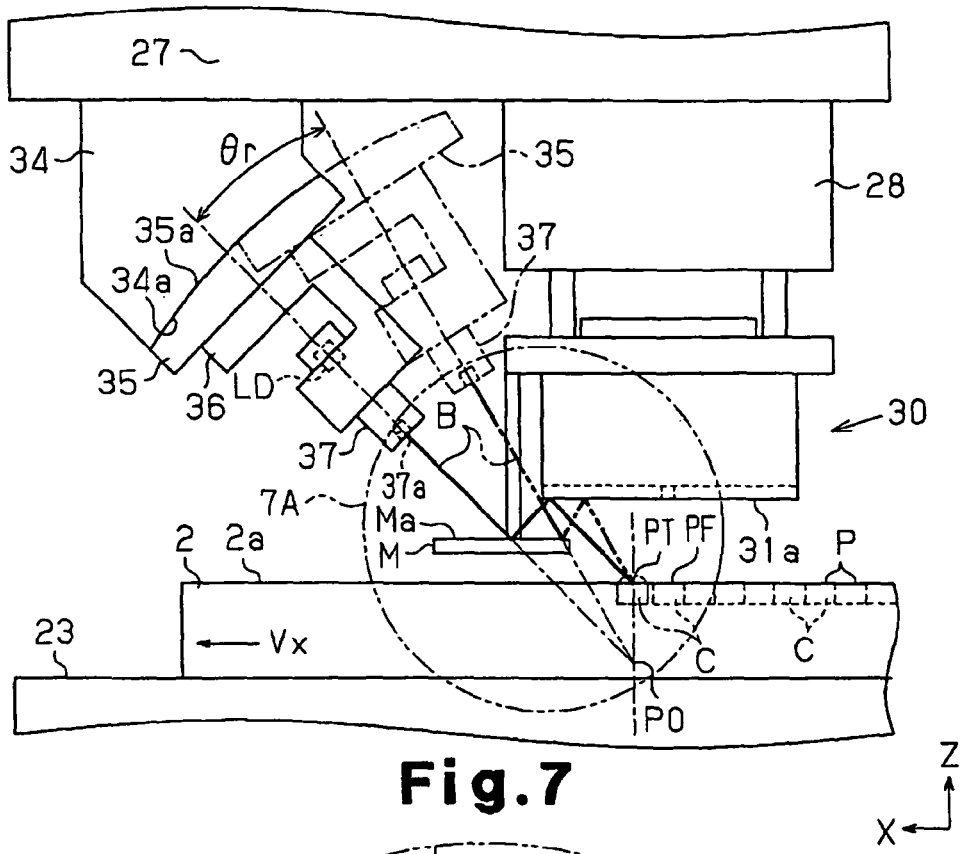
FIG. 7 is a view showing an ejection head according to a second embodiment of the present invention.
Figure 8:
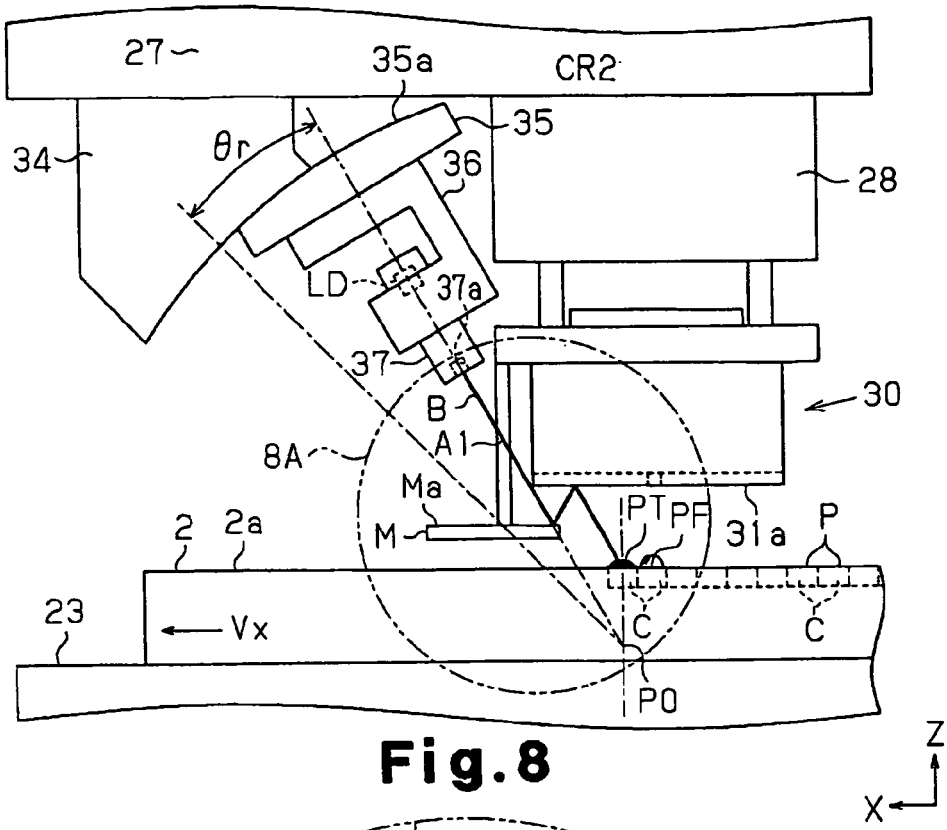
FIG. 8 is a view showing the ejection head of FIG. 7.

As shown in FIG. 7, the reflective mirror M is suspended from the support member 28 and arranged below the ejection head 30. A reflective surface Ma is formed on the surface of the reflective mirror M opposed to the ejection head 30 and extends parallel with the surface 2*a* of the substrate 2. The reflective surface Ma functions as a first reflective surface and regularly reflects the laser beams B, which have been radiated onto the reflective surface Ma, toward the nozzle forming surface 31*a*.

The nozzle plate 31, or a second reflector, is formed in the ejection head 30 and arranged at the right side of the reflective mirror M, or in direction −X from the reflective mirror M. The nozzle plate 31 has the nozzle forming surface 31*a* that extends parallel with the surface 2*a* of the substrate 2 and the reflective surface Ma. The nozzle forming surface 31*a* functions as a second reflective surface and regularly reflects the laser beams B received from the reflective mirror M.

Figure 7A:
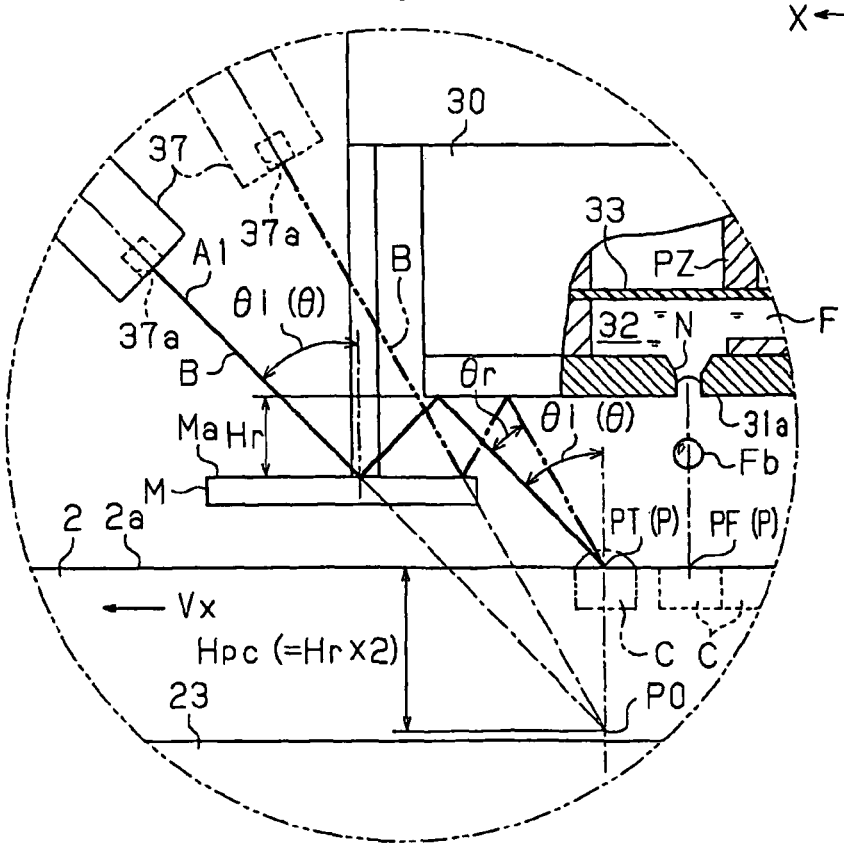
FIG. 7A is an enlarged partial view of a part of FIG. 4 indicated by a circle 7A.

As illustrated in FIG. 7A, in the second embodiment, the reflection distance Hr corresponds to the distance between the reflective surface Ma and the nozzle forming surface 31*a*. Further, in this embodiment, the pivot axis P0 is located below the radiation target positions PT, or in direction −Z from the radiation target positions PT. Specifically, the pivot axis P0 is defined in such a manner that the distance between the pivot axis P0 and the radiation target positions PT (the reflection correcting distance Hpc) becomes twice as great as the reflection distance Hr.

Referring to FIG. 7, the guide member 34 is provided below the carriage 27. The guide member 34 is arranged forward from the support member 28 (the ejection head 30) in the proceeding direction of the substrate 2, or in direction +X. The guide member 34 forms a pivot mechanism. The guide member 34 extends along the entire width of the carriage 27 in direction Y and has an L-shaped cross-sectional shape. The guide member 34 has the guide surface 34*a*, which is the concave surface shaped in an arcuate manner with the center of radius corresponding to the pivot axis. P0 as viewed in direction Y. The guide surface 34*a* is provided along the entire width of the guide member 34 in direction Y.

The pivot stage 35 is provided at the guide surface 34*a* of the guide member 34. The pivot stage 35 forms the pivot mechanism. The pivot stage 35 has the sliding surface 35*a* shaped in a manner matching the shape of the guide surface 34*a*. Upon receiving a signal for pivoting the pivot stage 35 (a pivot motor drive signal SMR: see FIG. 6), the pivot motor MR rotates in a forward direction or a reverse direction. This pivots the pivot stage 35 clockwise or counterclockwise about the pivot axis P0, as viewed in FIG. 7.

In the second embodiment, as indicated by the corresponding solid lines of FIG. 7, the reference position of the pivot stage 35 corresponds to the position of the pivot stage 35 at which the sliding surface 35*a* contacts the guide surface 34*a*. Further, as indicated by the corresponding broken lines of the drawing, the radiating position of the pivot stage 35 corresponds to the position of the pivot stage 35 pivoted from the reference position in a clockwise direction at a predetermined angle (the pivot angle θr).

With reference to FIG. 7, the laser head 37 is secured to the pivot stage 35 through the positioning member 36, like the first embodiment. The laser head 37 radiates the laser beams B from the semiconductor lasers LD, which are incorporated in the laser head 37, toward the pivot axis P0 through the radiation ports 37*a*.

In the second embodiment, the radiation angle θ corresponds to the angle between the optical axis Al of each laser beam B radiated onto the reflected surface Ma and the normal direction of the substrate 2 (direction Z). The reference radiation angle θi corresponds to the radiation angle θ when the pivot stage 35 is located at the reference position.

The laser head 37 radiates the laser beams B radiated from the radiation ports 37*a* toward the pivot axis P0 with the pivot stage 35 arranged at the reference position. Then the laser beams B from the radiation ports 37*a* are regularly reflected by the reflective surface Ma and then by the nozzle forming surface 31*a* for one time. The laser beams B are then radiated onto the surface 2*a* at the reference radiation angle θi while maintaining the radiation angle θi.

Since the laser beam B radiated from each radiation port 37*a* is reflected upward on the reflective surface Ma at one time, the reflected beam B radiates above the pivot axis P0. Accordingly, the laser beam B radiated from the radiation port 37*a* toward the pivot axis P0 reaches the position offset from the pivot axis P0 in direction +Z by the amount the reflection distance Hr multiplied by twice the number n of times of reflection, Hr*2*n*, or the reflection correcting distance Hpc. That is, Hpc=Hr*2*n*).

The pivot motor MR is then rotated in the forward direction, thus moving the pivot stage 35 from the reference position to the radiating position. This pivots each of the radiation ports 37*a* clockwise about the pivot axis P0, as illustrated in FIG. 8. The radiation angle θ of the laser beam B is thus decreased from the reference radiation angle θi by the amount corresponding to the pivot angle θr.

Figure 8A:
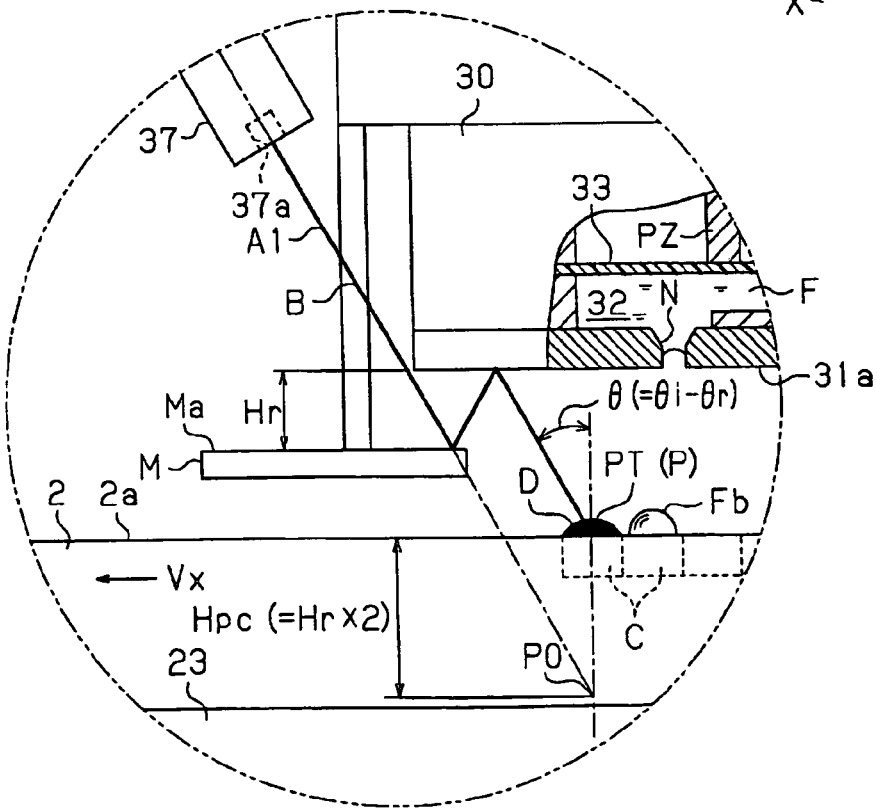
FIG. 8A is an enlarged partial view of a part of FIG. 4 indicated by a circle 8A.

In this state, the laser beam B radiated from the radiation port 37*a* reciprocates in a space between the reflected surface Ma and the nozzle forming surface 31*a*. Then laser beam B is then radiated onto the surface 2*a* in a manner proceeding along the optical axis Al, which has been pivoted at the pivot angle θr (as indicated by the corresponding double-dotted chain line, FIG. 8A).

In other words, the radiation angle θi is decreased by the amount corresponding to the pivot angle θr while the radiation target position PT is maintained.

Accordingly, by pivoting the pivot stage 35 at the pivot angle θr, the liquid ejection apparatus 20 may vary the radiation angle θ of each laser beam B by the amount corresponding to the pivot angle θr and maintain the radiating position of the laser beam B at the corresponding radiation target position PT.

The second embodiment, which is configured as above-described, has the following advantages.

The reflective surface Ma and the nozzle forming surface 31*a* that regularly reflect the laser beams B are arranged between the radiation ports 37*a* and the radiation target positions PT. The pivot axis P0 of the pivot stage 35 is located at the position spaced from the radiation target positions PT in direction −Z by the amount corresponding to the refection correcting distance Hpc. The pivot stage 35 is, or the radiation ports 37*a* of the laser head 37 are, pivoted about the pivot axis P0.

Therefore, regardless of changing of the radiation angle θ of each laser beam B, the radiating position of the laser beam B is maintained at the corresponding radiation target position PT. Accordingly, while maintaining the radiating position of each laser beam B and its positional accuracy, changing of the radiation angle θ with respect to the droplet Fb is carried out independently.

Further, regardless of such changing of the radiation angle θ, the distance (the optical path length) between each radiation port 37*a* and the corresponding radiation target position PT is maintained. Accordingly, the size and shape of the optical cross section formed on the surface 2*a* may be defined by the radiation angle θ only. Therefore, desired optical cross section or energy density of the laser beam B may be more reliably provided to the zones corresponding to the droplets Fb.

Since reflection between the reflective surface Ma and the nozzle forming surface 31*a* occurs in the second embodiment, the radiation angle θ of the laser beam B is closer to zero than that of the first embodiment. Further, the direction in which each laser beam B proceeds toward the corresponding droplet Fb approximates to direction Z. Accordingly, the radiation angle θ can be selected from a wider range, thus allowing more flexible setting of the conditions for drying the droplets Fb.

The illustrated embodiments may be modified as follows.

By decreasing the radiation angle θ and reducing output intensity of the laser beam B, only the optical cross section of each laser beam B radiated onto the corresponding droplet Fb may be reduced while maintaining the energy density of the laser beam B.

Further, the radiation angle θ may be increased by pivoting the pivot stage 35 counterclockwise. This enlarges the optical cross section of each laser beam B with respect to the droplet Fb, which decreases the energy density of the laser beam B. The conditions for drying the droplets Fb may be set more flexibly. This allows the selection of the material forming the droplets Fb from a wider range. The liquid ejection apparatus 20 thus becomes applicable to a wider range of use.

Each droplet receiving position PF may coincide with the corresponding radiation target position PT.

Instead of reflecting the laser beams B by the reflective surface Ma and the nozzle forming surface 31*a* for one time, such reflection by the reflective surface Ma and the nozzle forming surface 31*a* may be repeated for multiple times. In this case, it is preferred that the reflection correcting distance Hpc corresponds to the value obtained by multiplying the reflection distance Hr by twice the number of times of reflection of the laser beams B on the reflective surface Ma.

Instead of drying and baking the droplets Fb by the laser beams B, the droplets Fb may be caused to flow in a desired direction by the energy produced by the laser beams B. Alternatively, the droplets Fb may be subjected to pinning by restricting radiation of the laser beams B to the outer peripheral portions of the droplets Fb. That is, any other suitable process may be employed as long as marks are formed through radiation of the laser beams B onto the zones corresponding to the droplets Fb.

The marks formed with dots D are not restricted to the semispherical shapes but may be modified to oval dots or a linear mark.

Instead of the dots D of the identification code 10, the mark may be embodied as different types of thin films, metal wiring, or color filters of a liquid crystal display, an organic electroluminescence display, or a field effect type device (an FED or SED) having a flat electron emitting device. In other words, the mark may be embodied in any other suitable forms as long as the mark is provided through ejection of the droplets Fb. The field effect type device emits light from a fluorescent substance by radiating electrons emitted by the electron emitting device onto the fluorescent substance.

The substrate 2 may be a silicone substrate, a flexible substrate, or a metal substrate. The surface 2*a* onto which the droplets Fb are ejected may be one of the surfaces of these substrates. That is, the surface 2*a* may be any other suitable surface as long as the surface is one of the surfaces of an object on which a mark is formed through ejection of the droplets Fb.

Therefore, the present examples and embodiments are to be considered as illustrative and not restrictive and the invention is not to be limited to the details given herein, but may be modified within the scope and equivalence of the appended claims.

What is claimed is:

1. A method for forming a mark comprising:

ejecting a droplet of a liquid containing a mark forming material onto a surface of an object;

radiating a laser beam from a radiation port to a predetermined radiation target position;

moving at least one of the object and the radiation port relative to the other in such a manner that the laser beam radiated from the radiation port is radiated onto the droplet on the surface, wherein the droplet forms a mark on the surface by being irradiated with the laser beam; and pivoting the radiation port about the radiation target position as a pivot axis so as to set a radiation angle of the laser beam.

2. A liquid ejection apparatus comprising:

a liquid ejection head that ejects a droplet of a liquid containing a mark forming material onto a surface of a target;

a laser radiation device including a radiation port, the laser radiation device radiating a laser beam from the radiation port onto a predetermined radiation target position, the laser radiation device including a pivot mechanism, the pivot mechanism pivoting the radiation port about the radiation target position as a pivot axis so as to set a radiation angle of the laser beam; and a relative movement device that moves at least one of the object and the radiation port in such a manner that the laser beam radiated from the radiation port is radiated onto the droplet on the surface.

* * * * *